US010208565B2

(12) United States Patent
Brekke

(10) Patent No.: US 10,208,565 B2
(45) Date of Patent: Feb. 19, 2019

(54) SYSTEM AND METHOD FOR DELAYING ACTUATION USING A DESTRUCTIBLE IMPEDANCE DEVICE

(71) Applicant: Flowpro Well Technology A.S, Oslo (NO)

(72) Inventor: Kristian Brekke, Oslo (NO)

(73) Assignee: Flowpro Well Technology a.s., Oslo (NO)

( * ) Notice: Subject to any disclaimer, the term of this patent is extended or adjusted under 35 U.S.C. 154(b) by 12 days.

(21) Appl. No.: 15/481,876

(22) Filed: Apr. 7, 2017

(65) Prior Publication Data

US 2017/0204699 A1 Jul. 20, 2017

Related U.S. Application Data

(63) Continuation of application No. 14/549,035, filed on Nov. 20, 2014, which is a continuation of application No. 13/425,386, filed on Mar. 20, 2012, now Pat. No. 8,919,434.

(51) Int. Cl.

| | |
|---|---|
| ***E21B 34/00*** | (2006.01) |
| ***E21B 34/06*** | (2006.01) |
| ***E21B 34/14*** | (2006.01) |
| ***E21B 43/26*** | (2006.01) |

(52) U.S. Cl.

CPC ..... *E21B 34/063* (2013.01); *E21B 34/14* (2013.01); *E21B 43/26* (2013.01); *E21B 2034/007* (2013.01)

(58) Field of Classification Search

CPC ..... E21B 43/26; E21B 2034/007; E21B 34/14

See application file for complete search history.

(56) References Cited

U.S. PATENT DOCUMENTS

| | | | | |
|---|---|---|---|---|
| 2,488,819 | A | 11/1949 | Larkin | |
| 2,923,562 | A * | 2/1960 | Bagnell | E21B 17/07 166/237 |
| 7,726,406 | B2 | 6/2010 | Xu | |
| 8,356,671 | B2 * | 1/2013 | Guillory | E21B 21/103 166/193 |
| 2004/0163820 | A1 * | 8/2004 | Bishop | E21B 34/06 166/373 |
| 2006/0213670 | A1 * | 9/2006 | Bishop | E21B 34/06 166/386 |
| 2007/0084605 | A1 * | 4/2007 | Walker | E21B 23/006 166/313 |

(Continued)

*Primary Examiner* — Jennifer H Gay

(74) *Attorney, Agent, or Firm* — Spradley PLLC; Michael Spradley

(57) ABSTRACT

This disclosure relates to system and method for delaying actuation using a destructible impedance device. In one embodiment, a delayed actuating system can comprise a base pipe comprising a first portion of an orifice, a sliding sleeve around the base pipe, the sliding sleeve comprising a second portion of said orifice, further said sliding sleeve maneuverable into a first position, wherein said first portion of said orifice rests at least partially over said second portion of said orifice, a second position, a distance away from said second position. Further, the delayed actuating system can comprise a biasing device biasing the sliding sleeve toward the second position, and a destructible impedance device at least partially in side said orifice, the destructible impedance device preventing the sliding sleeve from leaving the first position.

14 Claims, 9 Drawing Sheets

(56) References Cited

U.S. PATENT DOCUMENTS

2007/0204995 A1* 9/2007 Hofman ..... E21B 34/14 166/308.1
2011/0100643 A1* 5/2011 Themig ..... E21B 34/102 166/373
2011/0240301 A1* 10/2011 Robison ..... E21B 23/006 166/334.1
2011/0240311 A1* 10/2011 Robison ..... E21B 23/04 166/373
2011/0315390 A1* 12/2011 Guillory ..... E21B 21/103 166/329
2012/0097397 A1* 4/2012 Hofman ..... E21B 43/12 166/308.1
2012/0097398 A1* 4/2012 Ravensbergen ..... E21B 34/102 166/308.1
2012/0111574 A1* 5/2012 Desranleau ..... E21B 34/14 166/373
2012/0305265 A1* 12/2012 Garcia ..... E21B 34/063 166/373
2013/0168099 A1* 7/2013 Themig ..... E21B 34/103 166/308.1
2013/0248189 A1* 9/2013 Brekke ..... E21B 34/14 166/308.1
2013/0248190 A1* 9/2013 Brekke ..... E21B 34/14 166/308.1
2013/0248193 A1* 9/2013 Brekke ..... E21B 34/063 166/317
2014/0014347 A1* 1/2014 Adam ..... E21B 34/14 166/308.1
2014/0083680 A1* 3/2014 Brekke ..... E21B 34/10 166/250.01
2015/0027706 A1* 1/2015 Symms ..... E21B 34/066 166/289
2017/0204699 A1* 7/2017 Brekke ..... E21B 34/063
2017/0254165 A1* 9/2017 Coon ..... E21B 23/08

* cited by examiner

SYSTEM AND METHOD FOR DELAYING ACTUATION USING A DESTRUCTIBLE IMPEDANCE DEVICE

BACKGROUND

This disclosure relates to a fracturing system and method for acquiring oil and gas.

The demand for natural gas and oil has significantly grown over the years making low productivity oil and gas reservoirs economically feasible, where hydraulic fracturing plays an important part in these energy productions throughout the world. For several decades different technology has been used to enhance methods for producing resources from oil and gas wells. Long horizontal wellbores with multiple fractures is one commonly used process to enhance extraction of oil and gas from wells. This process starts after a well has been drilled and the completion has been installed in the wellbore. Multi-stage hydraulic fracturing is a method that involves pumping large amounts of pressurized water or gel, a proppant and/or other chemicals into the wellbore to create discrete multiple fractures into the reservoir along the wellbore.

One of the technologically advanced methods being used today is simultaneous proppant fracturing of up to thirty fractures in one pumping operation. This method involves usage of proppant to prevent fractures from closing. However, this practice can usually cause an uneven distribution of proppant between the fractures, which will reduce the efficiency of the fracture system. As a result, this practice can also cause fractures to propagate in areas that are out of the target reservoir. Thus, such method can be inefficient and unsafe.

Additionally, proppant fracturing usually involves multiple steps and requires several tools in order to be performed successfully. Such practice that will allow even distribution of proppant between fractures highly depends on setting, plugs between the fracture stages or using frac balls of increasing sizes. In these methods, plugs are either set after each fracture has been perforated and pumped, or frac balls are dropped from the surface to successively open fracturing valves placed along the well. For each stage, balls of different diameters are dropped into the well corresponding to a specific fracturing valve's seat. At a point in the well, the ball will no longer pass through due to a decrease in well diameter. Once the ball is in place, fracturing can take place. After fracturing, the plugs must be drilled out and the balls must be recovered. With each fracturing stage while setting plugs, much time and energy is expended in tripping out of the hole between the stages and drilling out the plugs. Moreover, land-based rigs are usually rented per day basis, and so any delays can be quite expensive. Also, only about 12 different fracture stages is possible with the ball method before a restriction in flow area due to small ball diameter makes fracturing difficult due to large pressure losses.

As such it would be useful to have an improved system and method for fracturing oil and gas wells.

SUMMARY

This disclosure relates to a system and method for delaying actuation using a destructible impedance device. In one embodiment, a delayed actuating system can comprise a base pipe comprising a first portion of an orifice, a sliding sleeve around the base pipe, the sliding sleeve comprising a second portion of said orifice, further said sliding sleeve maneuverable into a first position, wherein said first portion of said orifice rests at least partially over said second portion of said orifice, a second position, a distance away from said second position. Further, the delayed actuating system can comprise a biasing device biasing the sliding sleeve toward the second position, and a destructible impedance device at least partially in side said orifice, the destructible impedance device preventing the sliding sleeve from leaving the first position.

Additionally, a method of delaying actuation comprising is disclosed. The method can comprise connecting a base pipe within a pipe string, the base pipe comprising a first portion of an orifice, applying a force on a sliding sleeve using a biasing device, the force configured to actuate the sliding sleeve from a first position to a second position, the sliding sleeve comprising a second portion of an orifice, the sliding sleeve positionable into said first position, wherein the second position of the orifice rests at least partially over the first portion of the orifice, said second portion, a distance away from the second position, and preventing the sliding sleeve from leaving the first position using a destructible impedance device.

DETAILED DESCRIPTION

Described herein is an improved fracturing system and method for acquiring oil and gas. The following description is presented to enable any person skilled in the art to make and use the invention as claimed and is provided in the context of the particular examples discussed below, variations of which will be readily apparent to those skilled in the art. In the interest of clarity, not all features of an actual implementation are described in this specification. It will be appreciated that in the development of any such actual implementation (as in any development project), design decisions must be made to achieve the designers' specific goals (e.g., compliance with system- and business-related constraints), and that these goals will vary from one implementation to another. It will also be appreciated that such development effort might be complex and time-consuming, but would nevertheless be a routine undertaking for those of ordinary skill in the field of the appropriate art having the benefit of this disclosure. Accordingly, the claims appended hereto are not intended to be limited by the disclosed embodiments, but are to be accorded their widest scope consistent with the principles and features disclosed herein.

Figure 1A:
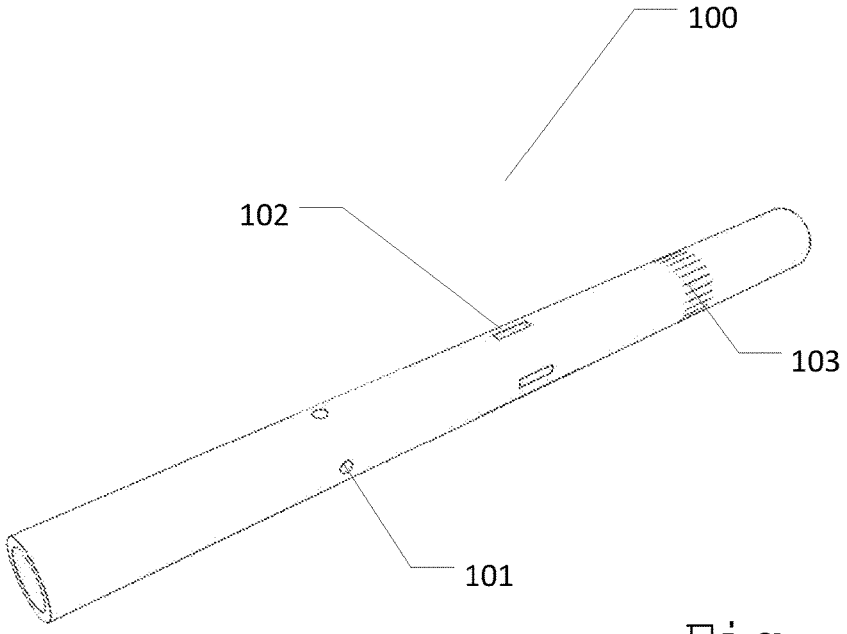
FIG. 1A illustrates a side view of a base pipe.

FIG. 1A illustrates a side view of a base pipe 100. Base pipe 100 can be connected as a portion of a pipe string. In one embodiment, base pipe 100 can be a cylindrical material that can comprise different wall openings and/or slots. Base pipe 100 wall openings can comprise insert port 101, fracturing port 102, and/or production port 103. Insert port 101 can be made of one or more small openings in a base pipe 100. Fracturing port 102 can also be made of one or more openings. Further, production port 103 can be a plurality of openings in base pipe 100.

Figure 1B:
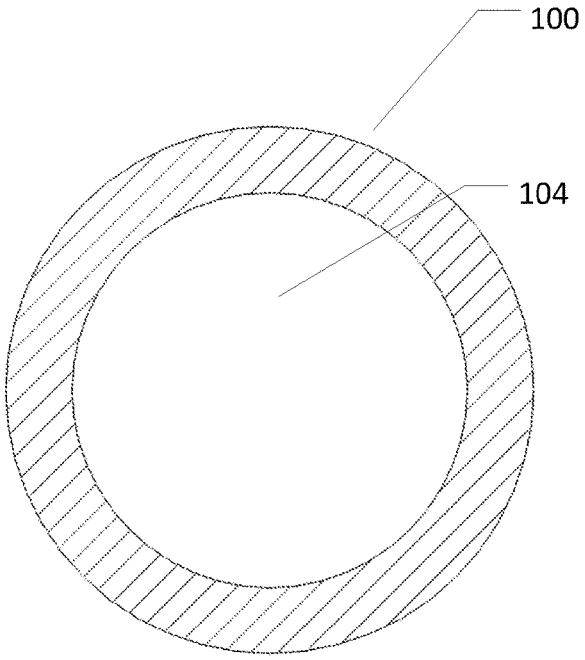
FIG. 1B illustrates a front view of a base pipe.
Figure 1C:
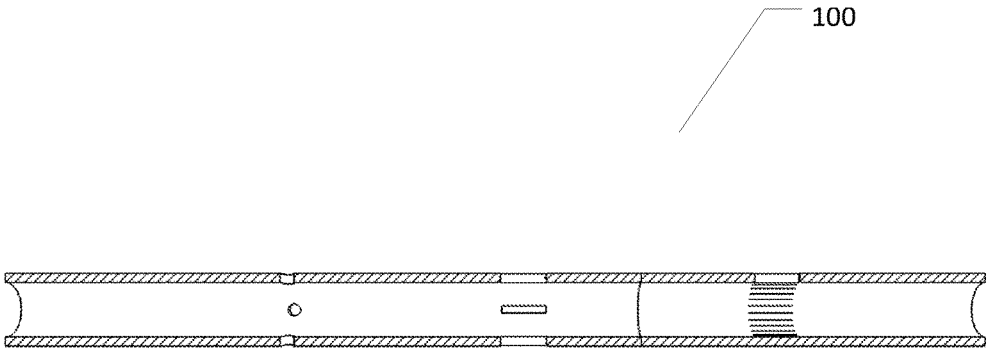
FIG. 1C illustrates a cross sectional view of a base pipe.

FIG. 1B illustrates a front view of base pipe 100 further comprising a chamber 104. Chamber 104 can be a cylindrical opening or a space created inside base pipe 100. As such chamber 104 can be an opening that can allow material, such as frac fluid or hydrocarbons to pass through. FIG. 1C illustrates a cross sectional view of a base pipe 100. Each wall opening discussed above can be circularly placed around base pipe 100.

Figure 2A:
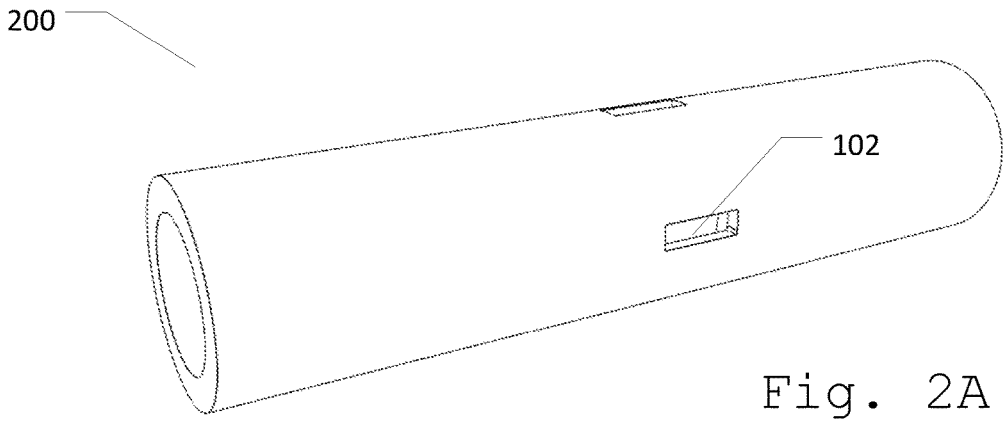
FIG. 2A illustrates a sliding sleeve.
Figure 2B:
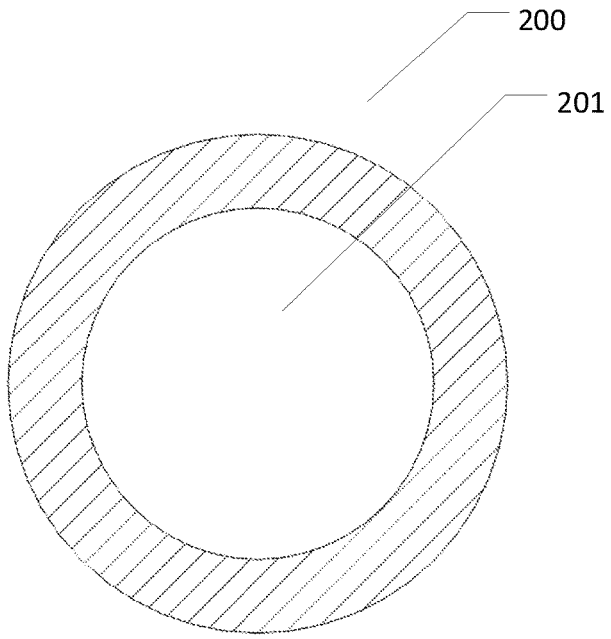
FIG. 2B illustrates a front view of a sliding sleeve.

FIG. 2A illustrates a sliding sleeve 200 connected to a fixed sleeve 205 by an actuator 206, and in line with an outer ring 207. In one embodiment, sliding sleeve 200 can be a cylindrical tube that can comprise fracturing port 102. Thus fracturing port 102 can have a first portion within base pipe 100 and a second portion within sliding sleeve 200. FIG. 2B illustrates a front view of a sliding sleeve 200 further comprising an outer chamber 201. In one embodiment outer chamber 201 can be an opening larger than chamber 104. As such outer chamber 201 can be large enough to house base pipe 100.

Figure 2C:
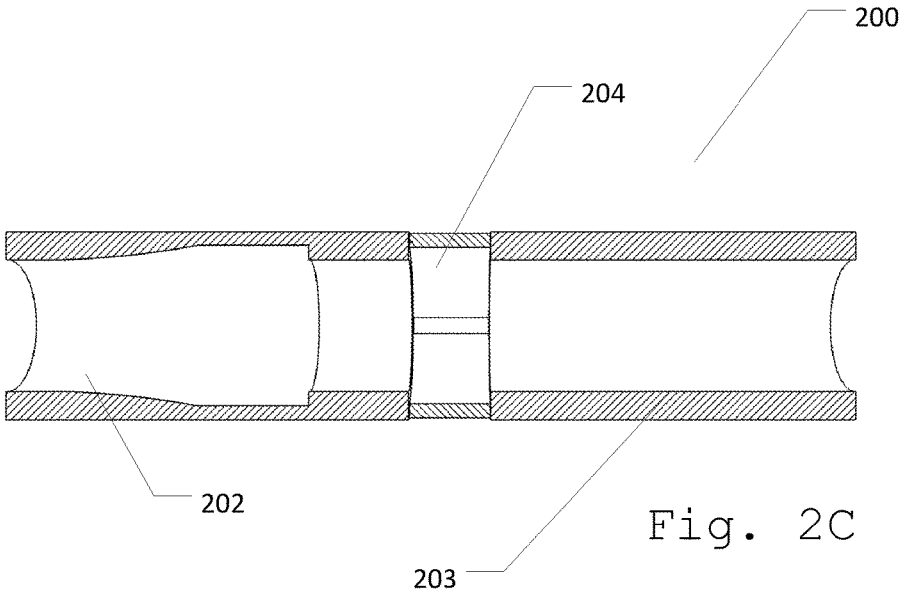
FIG. 2C illustrates a cross sectional view of a sliding sleeve.

FIG. 2C illustrates a cross sectional view of a sliding sleeve 200. Sliding sleeve 200 can comprise a first sleeve 202 and a second sleeve 203. First sleeve 202 and second sleeve 203 can be attached through one or more curved sheet 204, the spaces between each curved sheet 204 defining a portion of fracturing port 102. Inner surface of first sleeve 202 can have a bottleneck void, or any other void within the inner surface. The void can extend radially around the complete inner diameter of base pipe 100, partially around the inner diameter, or locally. If completely around the inner diameter, the ends of inner surface can have a smaller diameter than the void.

Figure 2D:
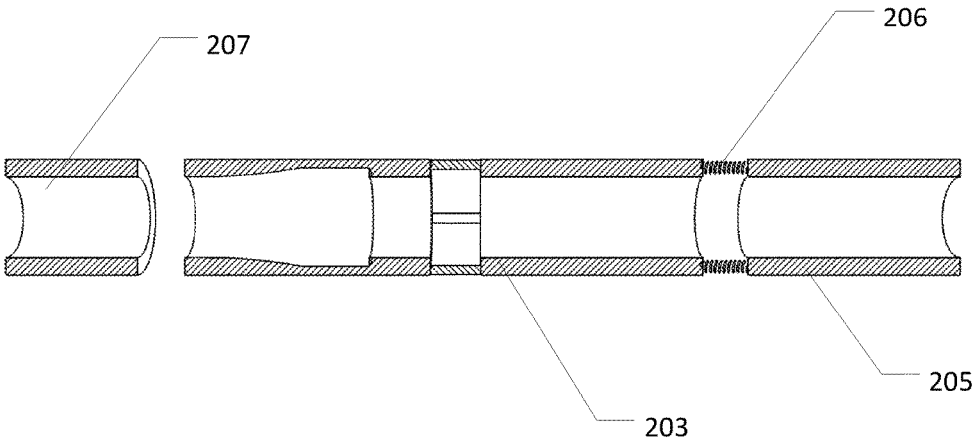
FIG. 2D illustrates a cross sectional view of a sliding sleeve that further comprises a fixed sleeve, and an actuator.

FIG. 2D illustrates a cross sectional view of a sliding sleeve 200 further comprising fixed sleeve 205, and actuator 206. In one embodiment, actuator 206 can be a biasing device. In such embodiment, biasing device can be a spring. In another embodiment, actuator 206 can be bidirectional and/or motorized. In one embodiment second sleeve 203 of sliding sleeve 200 can be attached to fixed sleeve 205 using actuator 206. In one embodiment, sliding sleeve 200 can be pulled towards fixed sleeve 205, thus compressing or otherwise load actuator 206 with potential energy. Later actuator 206 can be released or otherwise instigated, pushing sliding sleeve 200 away from fixed sleeve 205.

Figure 3A:
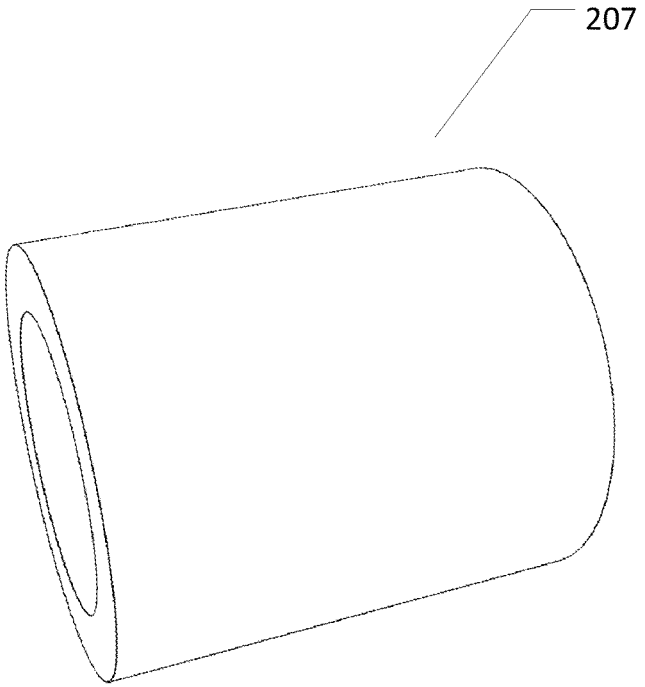
FIG. 3A illustrates a peripheral view of outer ring.
Figure 3B:
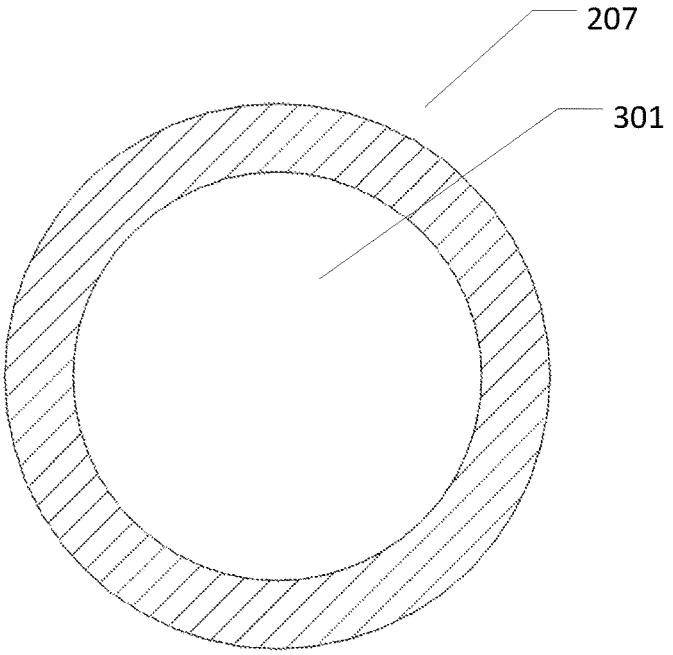
FIG. 3B illustrates a front view of an outer ring.

FIG. 3A illustrates a peripheral view of outer ring 207. In one embodiment outer ring 207 can be a solid cylindrical tube forming a ring chamber 301, as seen in FIG. 3B. In one embodiment outer ring 207 can be an enclosed solid material forming a cylindrical shape. Ring chamber 301 can be the space formed inside outer ring 207. Further, ring chamber 301 can be large enough to slide over base pipe 100.

Figure 4A:
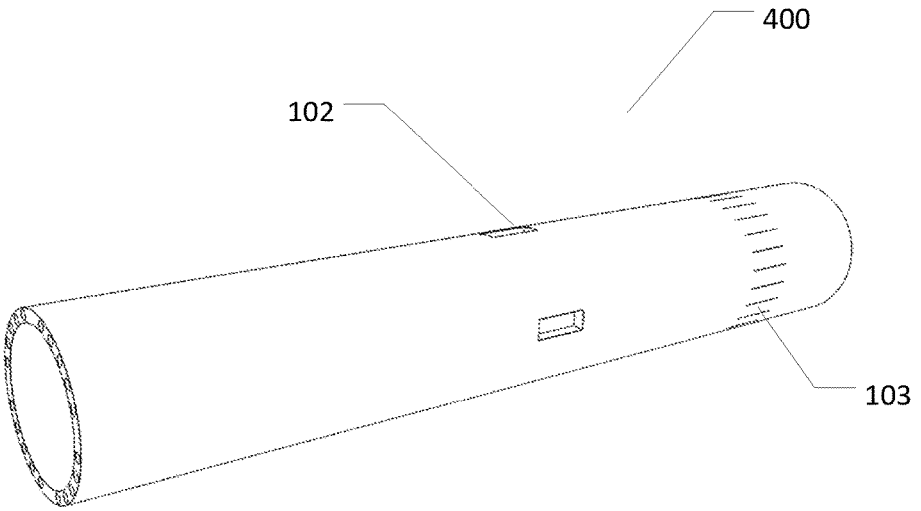
FIG. 4A illustrates a valve casing.
Figure 4B:
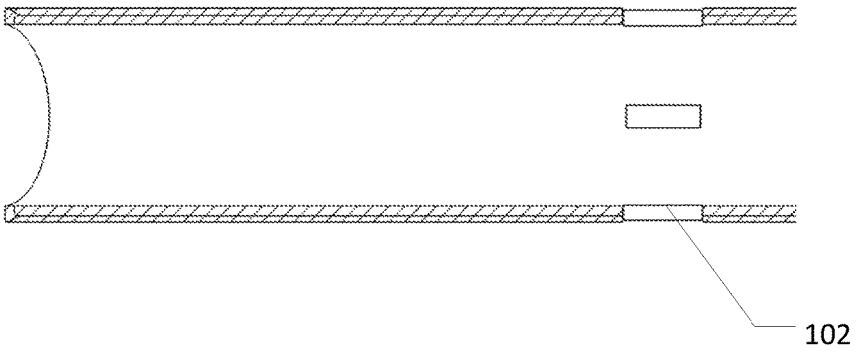
FIG. 4B illustrates a fracturing port of a valve casing.
Figure 4C:
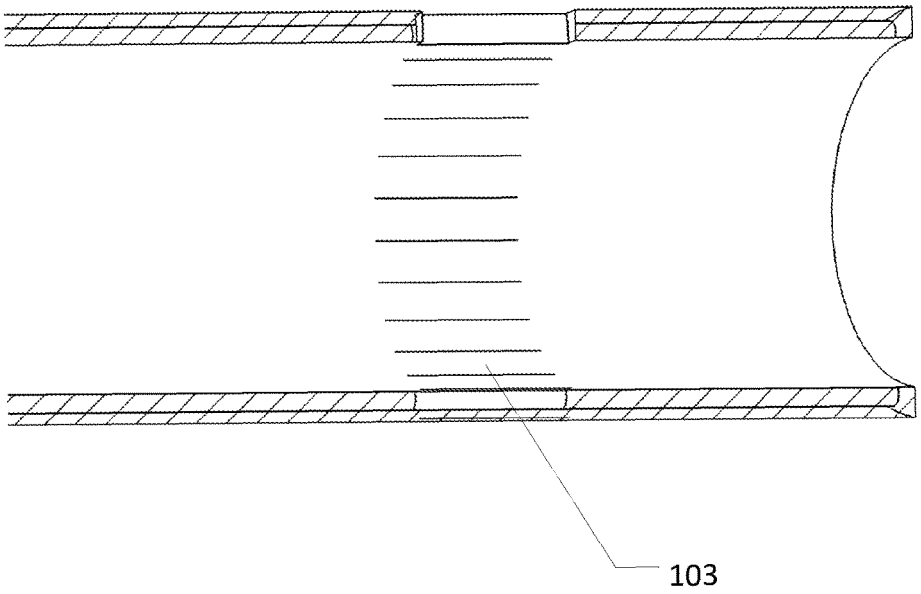
FIG. 4C illustrates a production slot of a valve casing.

FIG. 4A illustrates a valve casing 400. In one embodiment, valve casing 400 can be a cylindrical material, which can comprise fracturing port 102, and production port 103. In one embodiment, fracturing port 102 can be a plurality of openings circularly placed around valve casing 400, as seen in FIG. 4B. Further, production port 103 can be one or more openings placed around valve casing 400, as seen in FIG. 4C.

Figure 5:
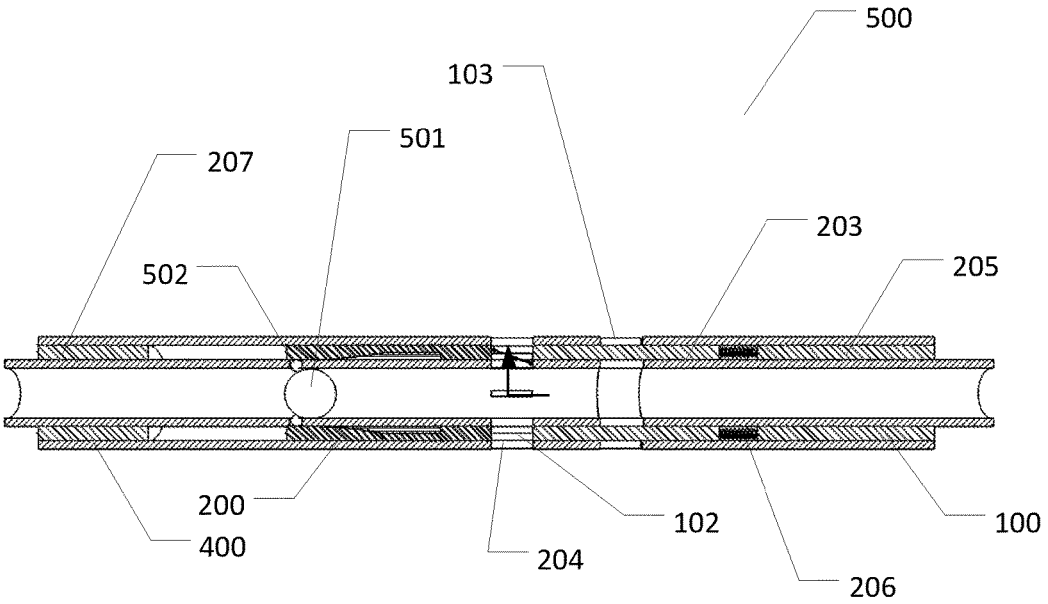
FIG. 5 illustrates a fracturing valve at a fracturing state.

FIG. 5 illustrates a fracturing valve 500 in fracturing mode. In one embodiment fracturing valve 500 can comprise base pipe 100, sliding sleeve 200, outer ring 207, and/or valve casing 400. In such embodiment, base pipe 100 can be an innermost layer of fracturing valve 500. A middle layer around base pipe 100 can comprise outer ring 207 fixed to base pipe 100 and sliding sleeve 200, wherein fixed sleeve 205 is fixed to base pipe 100. Fracturing valve 500 can comprise valve casing 400 as an outer later. Valve casing 400 can, in one embodiment, connect to outer ring 207 and fixed sleeve 205. In a fracturing position, fracturing port 102 can be aligned and open, due to the relative position of base pipe 100 and sliding sleeve 200.

Fracturing valve 500 can further comprise a frac ball 501, and one or more stop balls 502. In one embodiment, stop ball 502 can rest in insert port 101. At a fracturing state, actuator 206 can be in a closed state, pushing stop ball 502 partially into chamber 104. In such state, frac ball 501 can be released from the surface and down the well. Frac ball 501 will be halted at insert port 101 by any protruding stop balls 502 while fracturing valve 500 is in a fracturing mode. As such, the protruding portion of stop ball 502 can halt frac ball 501. In this state, fracturing port 102 will be open, allowing flow of proppant from chamber 104 through fracturing port 102 and into a formation, thereby allowing fracturing to take place.

Figure 6:
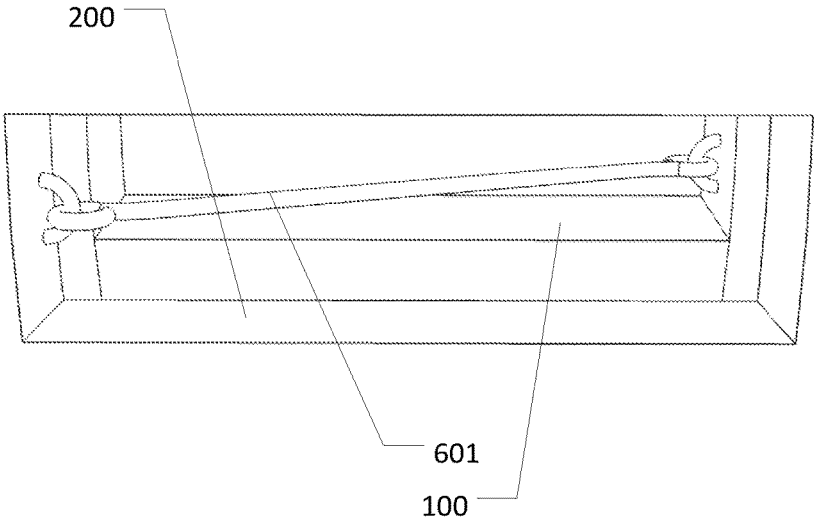
FIG. 6 illustrates one example of an impedance device counteracting actuator, in an embodiment where impedance device is a tension device such as a string.

FIG. 6 illustrates one example of an impedance device counteracting actuator 206, in an embodiment where impedance device is a tension device such as a string 601. String 601 can connect sliding sleeve 200 with base pipe 100. While intact, string 601 can prevent actuator 206 from releasing. As biasing device attempts to push or pull sliding sleeve 200 in one direction, it also applies a tension on string 601. String 601 prevents actuator 206 from actuating. Once the string 601 is broken, broken, actuator 206 can push sliding sleeve 200.

Figure 7:
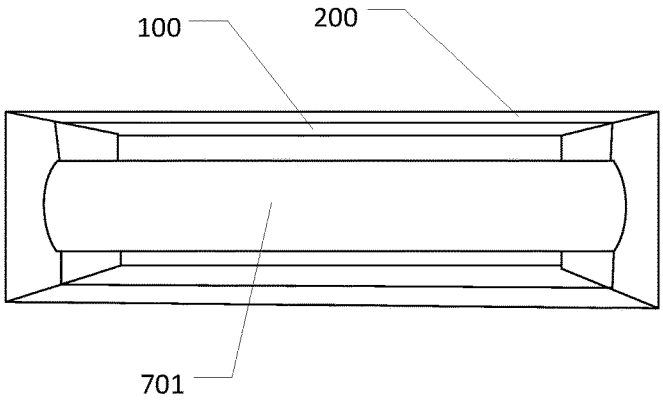
FIG. 7 illustrates one example of an impedance device counteracting actuator, in an embodiment where impedance device is a compression device such as a bar.

FIG. 7 illustrates a second example of an impedance device counteracting actuator 206, in an embodiment wherein impedance device is compression device such as a bar 701. While intact, bar 701 can prevent actuator 206 from releasing. As actuator 206 attempts to push or pull sliding sleeve 200 in one direction, it applies a tension force bar 701. Bar 701 can be held in place in a number of ways. In one embodiment, bar 701 can be connected to base pipe 100 and/or sliding sleeve 200 in a fixed manner. In another embodiment, the sheering force of sliding sleeve 200 and base pipe 100 can hold bar 700 into place. In another embodiment, bar 701 can fit into brackets attached to sliding sleeve 200 and/or base pipe 100.

In one embodiment, impedance device can be destructible. A destructible impedance device is one that is designed to fail under the right conditions. One method of breaking the impedance devices is by pushing a corrosive material reactive with impedance device through fracturing port 102, deteriorating the impedance until actuator 206 can overcome its impedance. This method can work in embodiments wherein impedance device comprises a corrodible material (such as animal hair in the case of string 601). Corrosives material can be an chemical such as hydrochloric acid. If impedance device comprises erodible material, then other methods can be used to break it. If impedance device is made of thin steel or some other material, it can predictably fail after enough fluid passes around it, eroding it over time.

Another method of breaking impedance device is by pushing a fluid comprising particulates such as sand, glass or rocks through fracturing port 102, in an embodiment wherein impedance device comprises an erodible material such as a soft rock, or sand that is mixed, formed and hardened with a weak epoxy. Another method of breaking the impedance devices is by pushing a large object such as a ball down the hole and through fracturing port 102. The systems and methods described in this disclosure regarding delaying actuation using an impedance device can work for orifices other than fracturing port 102, as well.

Figure 8:
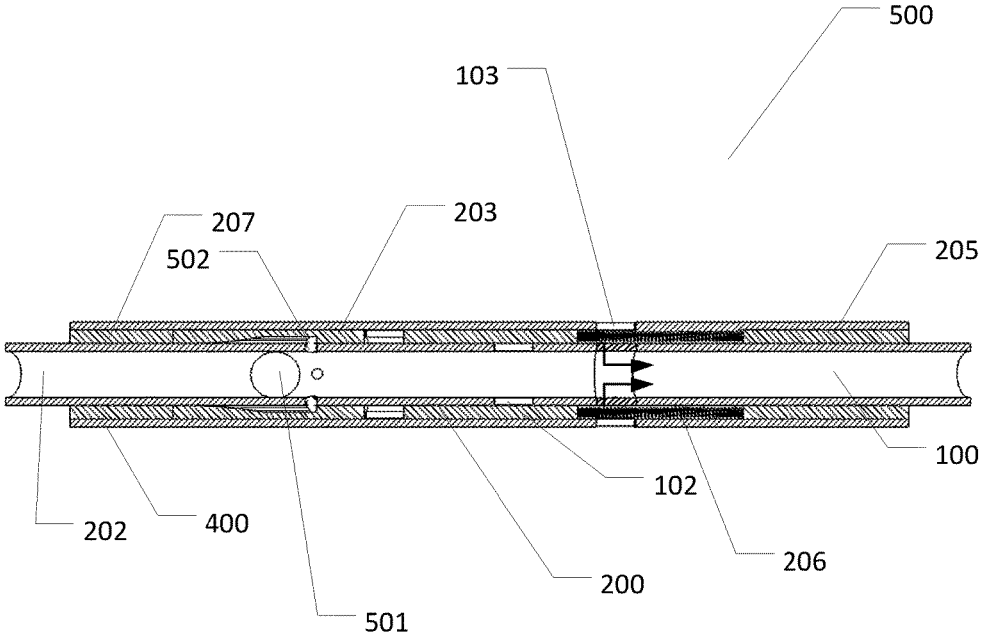
FIG. 8 illustrates fracturing valve at production state.

FIG. 8 illustrates fracturing valve 500 in production mode. As sliding sleeve 200 is pushed towards outer ring 207 by actuator 206, fracturing port 102 can close and production port 103 can open. Concurrently, frac ball 501 can push stop balls 502 back into the inner end of first sleeve 202 which can further allow frac ball 501 to slide through base pipe 100, to another fracturing valve 500. Once production port 103 is opened, extraction of oil and gas can start. In one embodiment, production ports can have a check valve to allow fracturing to continue downstream without pushing frac fluid through the production port.

Various changes in the details of the illustrated operational methods are possible without departing from the scope of the following claims. Some embodiments may combine the activities described herein as being separate steps. Similarly, one or more of the described steps may be omitted, depending upon the specific operational environment the method is being implemented in. It is to be understood that the above description is intended to be illustrative, and not restrictive. For example, the above-described embodiments may be used in combination with each other. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein."

What is claimed is:

1. A delayed actuating system comprising a base pipe comprising a first portion of an orifice; and a sliding sleeve around said base pipe, said sliding sleeve comprising a second portion of said orifice, wherein said sliding sleeve is positionable into a first position, wherein said first portion of said orifice rests at least partially over said second portion of said orifice; and a second position, a distance away from said first position;

a biasing device biasing said sliding sleeve toward said second position; and a destructible impedance device at least partially inside said first portion of said orifice, and at least partially inside said second portion of said orifice, said destructible impedance device preventing said sliding sleeve from leaving said first position, wherein said destructible impedance device is a string, said string destructible by applying a tension force on said string.

2. The delayed actuating system of claim 1 wherein said impedance device is dissolvable by a chemical.

3. The delayed actuating system of claim 2 wherein said chemical is hydrochloric acid.

4. The delayed actuating system of claim 1 wherein said impedance device is destructible by erosion.

5. The delayed actuating system of claim 4 wherein said impedance device is erodible by particulates in a fluid stream passing through said orifice.

6. The delayed actuating system of claim 1 wherein said impedance device is breakable by pushing an object through said orifice.

7. The delayed actuating system of claim 1 wherein said orifice is a fracturing port.

8. A method of delaying actuation comprising connecting a base pipe within a pipe string, said base pipe comprising a first portion of an orifice;

applying a force on a sliding sleeve using a biasing device, said force configured to actuate said sliding sleeve from a first position to a second position, said sliding sleeve comprising a second portion of said orifice, said sliding sleeve positionable into said first position, wherein said second portion of said orifice rests at least partially over said first portion of said orifice; and said second position, a distance away from said first position;

preventing said sliding sleeve from leaving said first position using a destructible impedance device, said impedance device at least partially within said first portion of said orifice, and at least partially within said second portion of said orifice, wherein said destructible impedance device is a string, said string destructible in part by applying a tension force on said string.

9. The method of claim 8, wherein said impedance device is destructible by a chemical.

10. The method of claim 9, further comprising the step pouring hydrochloric acid through said orifice to break said impedance device.

11. The method of claim 8 wherein said impedance device is destructible by erosion.

12. The method of claim 11, further comprising the step sending a fluid comprising particulates through said orifice to erode said impedance device.

13. The method of claim 8 further comprising pushing an object though said orifice to break said impedance device.

14. The method of claim 8 wherein said orifice is a fracturing port.

* * * * *